United States Patent [19]

Ohtake et al.

[11] Patent Number: 4,770,764

[45] Date of Patent: Sep. 13, 1988

[54] PROCESS FOR CONVERTING HEAVY HYDROCARBON INTO MORE VALUABLE PRODUCT

[75] Inventors: Nobumitsu Ohtake, Setagaya; Koji Kuri, Fuji, both of Japan

[73] Assignee: Asahi Kasei Kogyo Kabushiki Kaisha, Japan

[21] Appl. No.: 931,964

[22] Filed: Nov. 18, 1986

Related U.S. Application Data

[63] Continuation of Ser. No. 588,932, Mar. 13, 1984, abandoned.

[30] Foreign Application Priority Data

| | | | |
|---|---|---|---|
| Mar. 19, 1983 | [JP] | Japan | 58-46437 |
| Mar. 19, 1983 | [JP] | Japan | 58-85447 |
| Dec. 2, 1983 | [JP] | Japan | 58-227992 |
| Dec. 7, 1983 | [JP] | Japan | 58-231094 |

[51] Int. Cl.[4] ..... C10G 51/02

[52] U.S. Cl. ..... 208/73; 208/59; 208/61; 208/108; 208/112; 208/130

[58] Field of Search ..... 208/108, 61, 130, 59, 208/112 L

[56] References Cited

U.S. PATENT DOCUMENTS

| | | | |
|---|---|---|---|
| 3,235,508 | 2/1966 | Mills | 208/112 L |
| 3,839,484 | 10/1974 | Zimmerman et al. | 208/61 |
| 3,842,138 | 10/1974 | Chahvekilian et al. | 208/130 |
| 3,898,299 | 8/1975 | Jones | 208/61 |
| 4,097,363 | 6/1978 | McKinney et al. | 208/61 |
| 4,134,825 | 1/1979 | Bearden, Jr. et al. | 208/108 |
| 4,214,977 | 7/1980 | Ranganathan et al. | 208/108 |
| 4,216,077 | 8/1980 | Chahvekilian et al. | 208/61 |
| 4,298,454 | 11/1981 | Aldridge et al. | 208/108 |
| 4,299,685 | 11/1981 | Khulbe et al. | 208/112 |
| 4,348,270 | 9/1982 | Bearden, Jr. et al. | 208/112 |
| 4,357,299 | 11/1982 | Bearden, Jr. et al. | 208/112 |
| 4,376,037 | 3/1983 | Dahlberg et al. | 208/111 |
| 4,389,301 | 6/1983 | Dahlberg et al. | 208/108 |
| 4,406,772 | 9/1983 | Sasaki et al. | 208/112 |
| 4,431,520 | 2/1984 | Giuliani et al. | 208/108 |
| 4,495,306 | 1/1985 | Budahn et al. | 208/112 |
| 4,578,181 | 3/1986 | Derouane et al. | 208/112 L |
| 4,579,646 | 4/1986 | Grosboll et al. | 208/112 L |
| 4,606,809 | 8/1986 | Garg | 208/59 |

FOREIGN PATENT DOCUMENTS

| | | | |
|---|---|---|---|
| 0073690 | 3/1983 | European Pat. Off. | 208/251 H |
| 332336 | 7/1930 | United Kingdom . | |
| 1052603 | 12/1965 | United Kingdom . | |
| 1050084 | 12/1966 | United Kingdom . | |
| 1539397 | 1/1979 | United Kingdom . | |
| 2096164 | 10/1982 | United Kingdom . | |
| 2108522 | 5/1983 | United Kingdom . | |
| 2135691 | 9/1984 | United Kingdom . | |

*Primary Examiner*—H. M. S. Sneed
*Assistant Examiner*—Helane Myers
*Attorney, Agent, or Firm*—Finnegan, Henderson, Farabow, Garrett & Dunner

[57] ABSTRACT

A process for converting a heavy hydrocarbon into a more valuable product which comprises:

adding to the heavy hydrocarbon at least two kinds of substances comprising an oil-soluble or water-soluble transition metal compound and an ultra-fine powder which can be suspended in a hydrocarbon and has an average particle size within the range from 5 to 1000 mμ;

thermally cracking the heavy hydrocarbon in the presence of a hydrogen gas or a hydrogen sulfide-containing hydrogen gas; and recovering the resulting lighter hydrocarbon oil.

12 Claims, 1 Drawing Sheet

PROCESS FOR CONVERTING HEAVY HYDROCARBON INTO MORE VALUABLE PRODUCT

This application is continuation, of application Ser. No. 06/588,932, filed 3/13/84 now abandoned.

BACKGROUND OF THE INVENTION

1. Field of the Invention

This invention relates to a process for converting a heavy hydrocarbon, particularly a heavy oil such as an atmospheric residue or a vacuum residue of crude oils, highly into lighter and more valuable product, and a process for further hydrotreating the lighter hydrocarbon oil, and also to a process for producing gaseous olefins and monocyclic aromatics from a heavy hydrocarbon as the feedstock by using these processes.

2. Description of the Prior Art

In recent years, in addition to the trend of converting crude oils to heavy oils, unbalance between the demand and the supply of petroleum products accompanied by the increase in demand of lighter oils is arousing social problems, and effective utilization of excessive heavy oils is nowadays an issue of crucial importance in the field of petroleum industries.

On the other hand, in production of gaseous olefins such as ethylene, propylene, butadiene, etc. and monocyclic aromatics such as benzene, toluene, xylene, etc., light hydrocarbons such as oil field gases or petroleum refinery by-products such as naphtha have been primarily employed. These are now suffering from shortage of supply with their costs being increased, and economical advantages to obtain gaseous olefins or monocyclic aromatics are becoming markedly lowered. Accordingly, in order to solve such a problem related to the structure of industries, various attempts have recently been made to produce petrochemical starting materials by hydrotreating lighter oils such as kerosenes, gas oils, vacuum gas oils, etc. followed by steam pyrolysis. However, in these methods, various kinds of oils employed as the feedstock are available as petroleum products, and the situation of starting material supply is the same as in the case of the light hydrocarbon such as naphtha.

Thus, in either petroleum industries or petrochemical industries, it is now an important task to convert a heavy oil into lighter and more valuable product for effective utilization as light petroleum products or starting materials for petroleum chemistry. Accordingly, a number of processes have been proposed for hydrocracking or thermal cracking of heavy oils, but none of these processes are not necessarily satisfactory for converting a heavy oil such as a vacuum residue into lighter product, since some drawbacks are involved.

For example, in a fixed-bed or fluidized-bed hydrocracking process in which the reaction is conducted in a reactor packed with a granular or powderly catalyst, when high conversion to lighter product is effected, by-produced carbon and metal components contained in the feedstock oil will be gradually deposited on the catalyst layer, whereby depletion in activity of the catalyst or plugging of the catalyst layer may be brought about.

On the other hand, when it is desired to accomplish high conversion of a heavy hydrocarbon to lighter product according to thermal cracking, so called coking phenomenon will be caused, which will lead to stopping of the operation. Therefore, this process is generally applicable only to conversion to lighter product to an extent such that coking poses no problem. For improvement of this point, the so called hydrobisbreaking process has been proposed. This process, however, cannot give sufficient coking inhibition effect even if the hydrogen pressure is increased to a high pressure of 300 $kg/cm^2$. The coker process is also proposed, in which conversion to lighter product is conducted while forming positively cokes. This process, in addition to the disposal of cokes by-produced in a large amount, cannot be free from the problem of lowered yield of light oil. Besides, the light oil obtained is enriched in aromatic components and olefin components, thus involving the drawback of poor quality.

Thus, in the prior art, even when attempted to convert a high boiling material into lighter product by catalytic processing of a heavy oil, impurities contained in the oil such as sulfur or heavy metals as a matter of course, particularly the presence of basic polymer compounds will markedly lower the acidic ability of the catalyst. As the result, there is involved the problem that the cracking activity due to acidity of the catalyst cannot persist. Also, in thermal cracking of a hydrocarbon in absence of catalyst, the reaction rate is known to be greater as its molecular weight is greater. However, since the reaction rates of side reactions such as cokes formation and polycondensation are also great, it is very difficult in reaction operations to increase the degree of cracking.

On the other hand, various techniques have been reported for hydrotreating heavy hydrocarbons by the reaction in a dispersed state with addition of solid materials. U.S. Pat. Nos. 3,131,142, 4,134,825, 4,172,814 and 4,285,804 disclose hydrotreatments by adding an oil-soluble metal compound or an emulsion of an aqueous solution of a water-soluble metal compound. U.S. Pat. Nos. 3,161,585 and 3,657,111 disclose hydrotreatments by using a thermally cracked colloidal material of an oil-soluble metal compound or vanadium sulfide colloid particles. Canadian Pat. Nos. 1,073,389, 1,076,983, U.S. Pat. Nos. 4,176,051, 4,214,977 and 4,376,695 disclose hydrocracking by using pulverized coal or pulverized coal coated with a metal salt. U.S. Pat. Nos. 3,707,461 and 4,299,685 disclose hydrotreatments by use of pulverized coal ash. U.S. Pat. Nos. 4,169,038, 4,178,227, 4,204,943, Japanese Laid-open Patent Publication Nos. 207688/1982 and 69289/1983 disclose hydrotreatments by using cokes by-produced or petroleum ash by-produced. Japanese Laid-open Patent Publication Nos. 40806/1979 141388/1981 disclose hydrocracking by using a desulfurized catalyst or a pulverized waste catalyst thereof. U.S. Pat. Nos. 4,066,530 and 4,067,799 disclose hydrotreatment by use of a combination of an oil-soluble metal compound and an iron component particle, Japanese Laid-open Patent Publication No. 108294/1983 by use of a combination of a metal compound and a metal-containing dust by-produced, and U.S. Pat. Nos. 3,331,769 and 4,376,037 by use of a combination of a metal compound and a porous solid catalyst or a porous carrier, respectively. However, most of these techniques employ the reactions approximate to desulfurization conditions, and they are proposals aiming at primarily metal removal, hetero-atom removal such as sulfur or nitrogen removal or residual carbon removal from heavy hydrocarbons. A part of these techniques employ a heavy hydrocarbon which can be cracked with relative ease as the feedstock and attempt to apply an appropriate degree of hydrocracking by utilizing a waste catalyst, cokes by-produced or a natural product. Thus, according to any of these techniques, when applied for high conversion of heavy hydrocarbons such as atmospheric residue or vacuum residue into lighter products, the technical problems from practical aspect such plugging of equipments and economical problems remain to be solved.

SUMMARY OF THE INVENTION

The present inventors have made extensive studies to overcome the drawbacks possessed by the processes of the prior art and to develop a process for converting highly a heavy hydrocarbon as the feedstock into lighter and more valuable product economically and at high yield. As a consequence, it has now been found that by adding at least two kinds of components of an oil-soluble or water-soluble transition metal compound and a ultra-fine powder having an average particle size within the range from 5 to 1000 mμ which can be suspended in a hydrocarbon to the feedstock of a heavy hydrocarbon and carrying out thermal cracking in the presence of hydrogen gas or hydrogen sulfide-containing hydrogen gas, side reactions of polycondensation reaction and cokes forming reaction can be suppressed and scaling (coking) in the equipment, particularly in the reaction zones, can be inhibited, whereby valuable light oils can be obtained economically, stable and at high yield from a heavy hydrocarbon, and at the same time deterioration of the residue can be suppressed to reduce its amount remarkable. The present invention has been accomplished on the basis of such a finding.

More specifically, the present invention provides a process for converting a heavy hydrocarbon into a more valuable product which comprises:

adding to the heavy hydrocarbon at least two kinds of substances comprising an oil-soluble or water-soluble transition metal compound and an ultra-fine powder which can be suspended in a hydrocarbon and has an average particle size of 5–1000 mμ;

thermally cracking the heavy hydrocarbon in the presence of a hydrogen gas or a hydrogen sulfide-containing hydrogen gas; and recovering the resulting lighter hydrocarbon oil.

DESCRIPTION OF PREFERRED EMBODIMENTS

Figure 1:
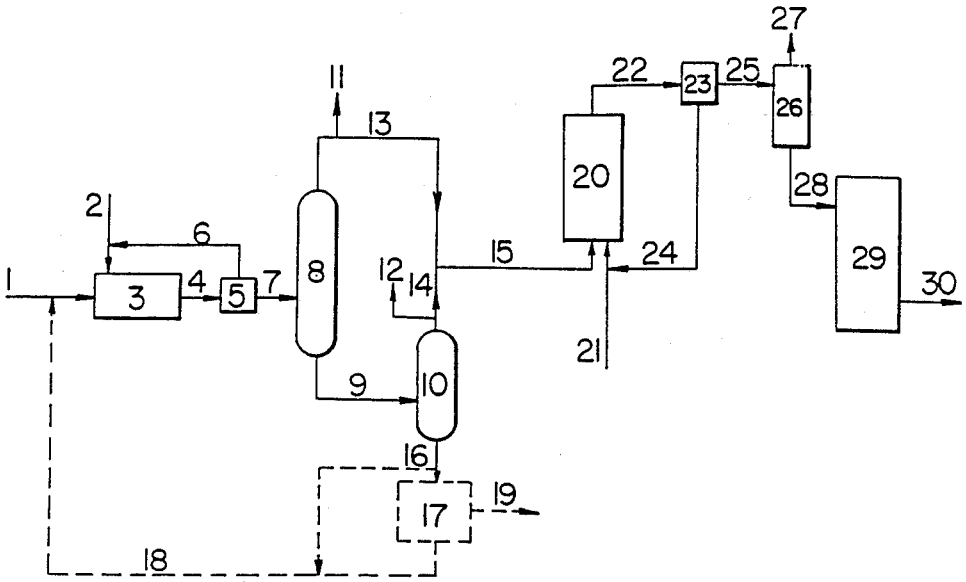
FIG. 1 and FIG. 2 show flow charts for practicing the different embodiments of the process for producing gaseous olefins and monocyclic aromatics, respectively, in which 3 is a cracking heater unit, 5 is a high pressure gas-liquid separator, 8 is an atmospheric flusher, 10 is a vacuum flusher, 17 is a liquid-solid separator, 20 is a hydrotreating units, 23 is a high pressure gas-liquid separator, 26 is a gas-liquid separator and 29 is a steam pyrolysis unit.

The heavy hydrocarbon to be used in the present invention is a crude oil or an atmospheric residue or a vacuum residue of a crude oil, including also shale oil, tar sand extract and liquefied coal oil. A heavy hydrocarbon containing a large amount of a fraction worthwhile giving high conversion of heavy oil into lighter, more valuable product, for example, a fraction having b.p. of 520° C. or higher under atmospheric pressure, has greater economical effects.

In the process for converting a heavy oil into lighter, more valuable product according to the present invention, a synergetic effect can be brought about by using at least two kinds of substances in combination. This may be considered to be exhibited due to the action a described below.

An oil-soluble or water-soluble transition metal compound may be considered to be converted by thermal treatment in the present of hydrogen and/or hydrogen sulfide in the reaction zone of a heavy hydrocarbon or in the stage prior thereto into a substance having a hydrotreating catalytic activity in a hydrocarbon thereby inhibiting polycondensation reaction or cokes precursor or cokes forming reaction which are inevitable side reaction in high conversion of a heavy hydrocarbon into lighter, more valuable hydrocarbon. In addition, other advantages are also exhibited such as suppression of the amount of the gases generated as by-product, prevention of deterioration of the properties of the oil produced by thermal cracking, etc.

On the other hand, a ultra-fine powder having an average particle size within the range from about 5 to 1000 mμ which can be suspended in a hydrocarbon may also be considered to prevent the scaling (coking) phenomenon in the reaction zone, which is also inevitable in high conversion of a heavy hydrocarbon into lighter, more valuable hydrocarbons, by ensuring floating state of cokes precursor, cokes or the like or through its ability to transport and migrate these materials. In addition, when a transition metal compound is converted to a substance having a hydrotreating catalytic activity, it may be considered to serve in forming high dispersibility and high surface area. As the result, there are additional advantages such that the effect can be exhibited with a small amount of the transition metal compound and that the effect can be exhibited even with a transition metal having weak hydrogenating function.

In practicing the process for high conversion of a heavy hydrocarbon into lighter, more valuable hydrocarbons of the present invention, it is essentially required that at least two kinds of substances of an oil-soluble or water-soluble transition metal compound or a substance having hydrotreating catalytic activity converted from such a compound and a ultra-fine powder having an average particle size within the range from about 5 to 1000 mμ should be simultaneously present in a heavy hydrocarbon. However, it is not necessary to prepare a specifically compounded mixture beforehand, but it is only sufficient to add separately these substances into a feedstock of a heavy hydrocarbon. Even when the respective components may be added separately, it may be considered that the transition metal compound interacts with the ultra-fine powder to be changed automatically into a substance system exhibiting a desired function in the reaction zone or at the stage prior to the reaction zone. The ultra-fine powder is required to be suspended in a heavy hydrocarbon. The "suspended" herein mentioned refers to the state where solid particles exist substantially in a liquid or the state where solid phases are distributed incontinuously through the liquid phase which is continuous phase, including those called as colloid, slurry or paste.

Of course, it is also possible to prepare a substance system capable of exhibiting a desired function with at least two kinds of substances beforehand and use this substance system for addition into the feedstock of a heavy hydrocarbon. For example, an oil-soluble transition metal compound is dissolved or an aqueous solution of a water-soluble transition metal compound is emulsified in an oil such as gas oil or vacuum gas oil, a ultra-fine powder having an average particle size within the range from about 5 to 1000 mμ is dispersed in the solution or emulsion. The resultant dispersion is subjected to the thermal treatment at a temperature at which the transition metal compound is decomposed in the presence of hydrogen gas or hydrogen sulfide-containing hydrogen gas to prepare a solid, which is separated or concentrated by a known solid-liquid separating method and added to a heavy hydrocarbon. The heavy hydrocarbon is then provided for use in a process for converting the heavy hydrocarbon into lighter, more valuable product by thermal cracking in the presence of hydrogen gas or hydrogen sulfide-containing hydrogen gas. As another example, a gaseous phase of hydrogen gas or hydrogen sulfide-containing hydrogen gas having a ultra-fine powder with an average particle size of about 5 to 1000 mμ is heated and into its atmosphere is sprayed an oil solution having an oil-soluble transition metal compound dissolved therein or an aqueous solution having a water-soluble transition metal compound dissolved therein to decompose the transition metal compound, followed by drying. The resultant solid is added to a heavy hydrocarbon, which is then subjected to thermal cracking in the presence of hydrogen gas or hydrogen sulfide-containing hydrogen gas to convert the heavy hydrocarbon into lighter, more valuable hydrocarbons. However, in the impregnation method or the precipitation method, in which the transition metal compound is supported on a ultra-fine powder, it is not desirable to use a preparation method in which agglomeration or sintering will occur between mutual transition metal compounds, between mutual ultra-fine powders or between the transition metal compound and the ultra-fine powder.

As another substance system having a desired function, it is also possible to reuse a thermally cracked product obtained by the present process for converting a heavy hydrocarbon into lighter, more valuable hydrocarbons or a heavy residue fractionated by distillation of the thermally cracked product as such, or alternatively to use a solid separated and recovered from these dispersed oils.

In the oil-soluble or water-soluble transition metal compound, the transition metal is inclusive of all the transition elements in the Periodic Table of Elements, and selected particularly from the group consisting of vanadium, chromium, iron, cobalt, nickel, copper, molybdenum, tungsten and mixtures thereof.

Examples of the oil-soluble compounds containing desired transition metals are so called $\pi$-complexes containing cyclopentadienyl group or allyl group as the ligand, organic carboxylic acid compounds, organic alkoxy compounds, diketone compounds such as acetylacetonate complex, carbonyl compounds, organic sulfonic acid or organic sulfinic acid compounds, xanthinic acid compounds such as dithiocarbamate, amine compounds such as organic diamine complexes, phthalocyanine complexes, nitrile or isonitrile compounds, phosphine compounds and others. Particularly preferable oil-soluble compounds are salts of aliphatic carboxylic acids such as stearic acid, octylic acid, etc., since they have high solubilities in oil, contain no hetero atom such as nitrogen or sulfur and can be converted with relative ease to a substance having hydrotreating catalytic activity. Compounds of smaller molecular weights are preferred, because less amounts may be used for the necessary amounts of the transition metal.

Examples of water-soluble compounds are carbonates, carboxylates, sulfates, nitrates, hydroxides, halogenide and ammonium or alkali metal salts of transition metal acids such as ammonium heptamolybenate.

In the case of an oil-soluble transition metal compound, it can be used as a solution by additing directly into the feedstock of a heavy hydrocarbon. However, in the case of a water-soluble transition metal compound, it is necessary to form an emulsion by adding an aqueous solution thereof into the feedstock of a heavy hydrocarbon. In this case, including the method employing an emulsifier, any of the known methods for emulsification may be applicable.

The ultra-fine powder having an average particle size within the range from about 5 to 1000 mμ which can be suspended in a hydrocarbon can exhibit excellent effects as described below as compared with solid catalysts, carriers employed for solid catalysts and merely crushed products of these known in the prior art of this field. That is to say, (1) it can ensure high dispersibility and great free movement in the reaction zone and can give a site for uniform reaction without localization; (2) it will reside scarcely in the reaction zone, but discharge easily adhered or deposited polycondensed products such as asphaltenes, cokes precursors, cokes, etc. under highly dispersed, floated state out of the reaction zone, thereby avoiding plugging in the reaction zone; and (3) it can prevent agglomeration of substances having hydrotreating catalytic activity formed from transition metal compound to effect high dispersion, thereby enhancing the activity of the substance having hydrotreating catalytic activity. In addition, the greatest feature of the ultra-fine powder is an extremely great outer surface area as compared with substantially porous solid catalysts and carriers. The solid catalysts and carriers of the prior art, even when crushed, will be broadly distributed generally in the range from several microns to some ten microns, having a very small outer surface. The effect expected is derived mostly from the inner surfaces within the pores. However, in the case when the reaction occurs within the pores, the diffusion rate of the reactants poses a problem, and there is created a concentration gradient of the reactants between the center portion of the particle and the vicinity of the surface, whereby the site for the reaction becomes ununiform. Accordingly, the effective coefficient is always the problem, and physical structures such as pore distribution or crushed particle size distribution may have effects greatly on the resultant performance. Besides, when employing a heavy hydrocarbon as the feedstock, substances having large molecular weights contained therein such as asphaltenes, porphyrin-like substances containing heavy metals and cokes precursors or cokes formed cannot enter to the inner portions of the pores but will readily plug the pores in the vicinity of the surface, whereby the inner surfaces depending substantially on the pores can function little to give no expected effect. In contrast, the ultra-fine powder is a substance system which is not substantially porous or not expected to be porous and can exhibit a desired effect through the effective action of only the large outer surface. The outer surface area will be dramatically increased as the particle sizes are smaller. For example, in the case of the particle sizes of 10 to 50 mμ, the surface area can be about 300 to 60 $m^2g$ to give an extremely excellent effect. The ultra-fine powder satisfying these properties can be classified into inorganic substances and carbonaceous, substances. Illustrative of inorganic substances are so called fine ceramics such as ultra-fine particulate silicic acid, silicates, alumina, titania, etc. and ultra-fine metal particles such as those obtained by the vapor deposition method. Of these substances to describe about ultra-fine particles of silicic acid acid silicates, these are a group of many kinds of substances called conventionally as white carbon, and they can be synthesized according to the vapor-phase processes such as by thermal decomposition of silicon halides, thermal decomposition of silicic acid-containing compounds, thermal decomposition of organic silicic compounds, etc.; and according the liquid-phase processes such as decomposition of sodium silicate with an acid, decomposition of sodium silicate with an ammonia salt or an alkali salt, formation of an alkaline earth metal silicate from sodium silicate followed by decomposition with an acid ion-exchange by treating an aqueous sodium silicate solution with an ion-exchange resin, pressurized decomposition of an organogel, decomposition of silicon halide with water, decomposition of sodium silicate solution with silicofluoric acid by-produced in the manufacturing step of calcium superphosphate, production utilizing natural silicic acid or silicates, the reaction of sodium silicate with a hydroxide such as calcium hydroxide or calcium chloride, aluminum chloride or sodium aluminate, the treatment of quartz or silica gel with calcium hydroxide in an autoclave, etc. The particle size can be measured by an electron microscope, and it may range approximately from 5 to 50 mμ, although different depending on the kind. As to the surface area, the outer surface area calculated from the particle size measured by an electron microscope and the specific surface area determined by the gas adsorption method (BET method) coincide substantially with each other, and it is within the range approximately from 50 to 400 $m^2/g$.

On the other hand, the carbonaceous substances are a group of substances obtained by formation of carbon, namely carbonization, which can be classified into liquid phase or solid phase carbonized substances such as petroleum cokes, coal cokes, pitch cokes, activated charcoal, charcoal, etc. and gas phase carbonized substances such as carbon blacks. Carbonaceous substances, as compared with inorganic substances, are combustible and therefore advantageous when the heavy residue which is a product after the reaction of converting a heavy hydrocarbon into lighter, more valuable hydrocarbons is utilized as boiler fuel.

Liquid phase or solid phase carbonized substances are generally great in particle sizes formed, and most of them are required to be subjected to micropulverization operation and classification operation in order to have desired particle sizes. On the other hand, most of the gas phase carbonized substances have particle sizes falling within the particle size range of the present invention, and therefore they are available as such. Among them, carbon blacks include a variety of kinds formed as the gas phase carbonized substances, which can be prepared according to the methods such as oil furnace method, gas furnace method, channel method, thermal method, acetylene black method, by-produced carbon black method, lamp black method and others. The particle size can be measured by an electron microscope and it is approximately 9 to 500 mμ, although different depending on the kind, approximately 9 to 100 mμ except for those produced by the thermal method. As to the surface area, the outer surface area calculated from the particle size measured by an electron microscope and the specific surface area determined by the gas adsorption method (BET method) coincide substantially with each other, and it is within the range of approximately from 5 to 400 $m^2/g$.

When the ultra-fine powder of the present invention is added to the feedstock of a heavy hydrocarbon, it may be added directly as such or as a concentrated dispersion in a different medium. The dispersion containing the ultra-fine powder may be subjected to mechanical operation such as by a stirrer, ultra-sonic wave or a mill, or alternatively or in combination admixed with dispersants such as a neutral or basic phosphonate, a metal salt such as sulfonic acid salt of calcium or barium, succinimide and succinate, benzylamine or a polypolar type polymeric compound.

In practicing the process for converting a heavy hydrocarbon into lighter, more valuable product, the amounts of at least two kinds of substances to be added may be within the range from 10 to 1000 ppm, more preferably from 50 to 500 ppm, for the transition metal compound calculated as metal based on the weight of the feedstock of a heavy hydrocarbon, and within the range of from 0.05 to 10% by weight, more preferably from 0.1 to 3% by weight, for the ultra-fine powder based on the weight of the feedstock of a heavy hydrocarbon. In the case of preparing a substance system capable of exhibiting the desired function of at least two kinds of substances beforehand, it is desirable to prepare a formulation having a composition so as to fall within the ranges as specified above. At a level of less than 10 ppm of the transition metal of the transition metal compound based on the heavy hydrocarbon or at a level of less than 0.05 wt. % of the ultra-fine powder, no sufficient effect of inhibiting the side reactions of polycondensation reaction and cokes forming reaction, and also no sufficient effect of preventing scaling (coking) can be obtained. On the other hand, in excess of 1000 ppm of the transition metal of the transition compound or in excess of 10 wt. % of the ultra-fine powder, no further improvement corresponding to such amounts can be recognized, but rather unfavorable side reactions or solid-liquid separation in the reaction zone and plugging accompanied thereby may occur.

In practicing the process for converting a heavy hydrocarbon into lighter, more valuable product, the thermal cracking conditions depend on the heavy hydrocarbon employed as the feedstock and the properties and amounts added of at least two kinds of substances, but, in general, the reaction temperature employed may range from 400° to 550° C., preferably from 430° to 520° C. At a higher temperature region exceeding this temperature range, thermal cracking will proceed so far that formation of cokes and generation of gases will become marked until there is substantially no feedstock to be converted into lighter oil. On the other hand, at a lower temperature region lower than this temperature range, the thermal cracking rate tends to become markedly slow.

The reaction pressure may be 30 $Kg/cm^2$ to 300 $Kg/cm^2$ preferably 50 $Kg/cm^2$ to 250 $Kg/cm^2$.

The thermal cracking may be operable by either batchwise or continuous system, and the reaction time or the time for residence of the heavy hydrocarbon within the reactor may be 1 minute to 2 hours, desirably 3 minutes to one hour. These processing conditions do not take individually optimum values, but they are related to each other, and therefore the optimum ranges may be changed depending on the situation. Further, the amount of hydrogen to be fed in practicing thermal cracking may be 100 to 5,000 $Nm^3/kl$, more preferably 500 to 2,000 $Nm^3/kl$, in terms of the volume ratio relative to the feedstock and it is generally desirable to continue running with supplement of hydrogen gas in an amount corresponding to the amount of hydrogen gas consumed. As the hydrogen to be fed, either high purity hydrogen gas or a gas mixture containing a large amount of hydrogen gas may be employed. Even when employing hydrogen sulfide-containing hydrogen gas, the amount to be used may be such as amount as corresponding to that as mentioned above as the total amount, but the content of hydrogen sulfide may preferably about 1 to 10 mole %.

The type of the reaction equipment when carrying out the reaction continuously may be either a tubular reactor, a tower reactor or a soaker type reactor, but in any of these reactors, it is desirable to perform suspension reaction while maintaining a ultra-fine powder under suspended state without forming a fixed-bed, fluidized-bed or ebullating-bed. The reactor structure can be simpler for suspension reaction, and the reaction temperature can be controlled more easily without change in performance with lapse of time and plugging by coking will hardly occur. In addition, a high temperature and short time reaction can be practiced with relative ease and therefore a great space velocity can be taken to afford a large amount of unit treatment, with additional advantage of making chemical consumption amount of hydrogen gas smaller while suppressing hydrogenating activity such as hydrogenation of aromatic nuclei.

Of the product oils obtained by practicing the process for converting a heavy hydrocarbon into lighter, more valuable product of the present invention, the destillates may be available as a whole or after fractionation as substitute for naphtha in petroleum chemistry, or can be separated into fractions having respective boiling ranges for use as intermediate starting materials for petroleum products such as gasoline, jet fuel oil, kerosene, gas oil, diesel fuel, lubricant and others.

In the process for further hydrotreating the hydrocarbon oil obtained as the lighter, more valuable product according to the process of the present invention, the hydrocarbon oil obtained may be subjected to hydrotreatment as such or after removal by separation of the high boiling fraction from the hydrocarbon oil obtained. Hydrotreating may advantageously be carried out after removal of the high boiling fraction, since substances such as asphaltenes or metals can be removed thereby. In addition, the high boiling fraction removed by separation can be handled substantially similarly as the liquid fuel oil, which can be utilized as the fuel source in the process practiced in the present invention or otherwise for use in boilers in general. As the method for separation of high boiling fraction, there may be employed conventionally used high pressure gas separation, atmospheric distillation, vacuum distillation and further solvent deasphalting.

The catalyst to be used in practicing the hydrotreating process may be any of the catalysts known for hydrotreating of petroleum fractions and heavy oils, preferably a catalyst containing each at least one kind of metals selected from the group VIb metals and the group VIII metals of the Periodic Table such as metal species of nickel-molybdenum, cobalt-molybdenum, nickel-tungsten and the like, supported on an inorganic porous carrier. These metal species are used generally as oxides or sulfides, and the inorganic porous carrier may include, for example, alumina, silica, silica-alumina, zeolite, zeolite-containing alumina, aluminaboria, silica-alumina-titania and others. The hydrotreating conditions may be selected as desired depending on the heavy hydrocarbon oil employed as the feedstock and the properties of the catalyst, but the reaction temperature may be 250° to 480° C., preferably 300° to 450° C. If the reaction temperature exceeds 480° C., thermal cracking of the side reaction proceeds too much, whereby increase of the carbon deposited on the catalyst, increase of the hydrogen consumed accompanied with increase of gas generation and reduction of liquid yield are recognized. On the other hand, at a temperature lower than 250° C., the reaction rate will become markedly smaller. The reaction pressure may be 3 to 300 $Kg/cm^2$, preferably 50 to 250 $Kg/cm^2$, which is related greatly to the hydrotreating capacity of the catalyst. Further, the liquid hourly space velocity (LHSV) may be 0.1 to 5.0 $hr^{-1}$, preferably 0.2 to 3.0 $hr^{-1}$, and the amount of hydrogen to be fed is within the range from 200 to 2000 $Nm^3/kl$ in terms of the volume ratio relative to the feedstock oil to be hydrotreated. These conditions are not selected so as to take individually optimum values, but they are related to each other and optimum ranges are to be selected in correspondence to the requirements, including of course the properties of the feedstock oil and the catalyst activity, and also the purpose of use of the hydrotreated product oil.

The process for producing gaseous olefins and monocyclic aromatic hydrocarbons by use of a heavy hydrocarbon as the feedstock comprises as a first embodiment:

(A) adding to a heavy hydrocarbon (i) at least two kinds of substances comprising an oil-soluble or water-soluble transition metal compound and an ultra-fine powder which can be suspended in a hydrocarbon and has an average particle size within the range from 5 to 1000 mμ; or (ii) a solid prepared by dissolving an oil-soluble transition metal compound in an oil or emulsifying an aqueous solution of a water-soluble transition metal in an oil; dispersing an ultra-fine powder having an average particle size within the range from 5 to 1000 mμ in the oil solution or in the oil/aqueous emulsion; and heating the dispersion at the decomposition temperature of the transition metal compound in the presence of a hydrogen gas or a hydrogen sulfide-containing hydrogen gas; or (iii) a solid prepared by dissolving an oil-soluble transition metal compound in an oil or dissolving a water-soluble transition metal compound in water and converting the solution to a dry solid by spraying the solution in a hydrogen gas or a hydrogen sulfide-containing hydrogen gas in which an ultra-fine powder having an average particle size within the range from 5 to 1000 mμ is dispersed and by simultaneously heating the gas to decompose the transition metal compound and to dry the solid;

(B) thermally cracking the heavy hydrocarbon in the presence of a hydrogen gas or a hydrogen sulfide-containing hydrogen gas and recovering the resulting lighter hydrocarbon oil;

(C) removing a fraction having a high boiling point from the lighter hydrocarbon oil; and (D) pyrolyzing a fraction having a low boiling point or a mixture of the fraction and a petroleum fraction with steam, and recovering a gaseous olefins product and a monocyclic aromatics product.

Alternatively, according to a second embodiment, the process comprises:

(A) adding to a heavy hydrocarbon (i) at least two kinds of substance comprising an oil-soluble or water-soluble transition metal compound and an ultra-find powder which can be suspended in a hydrocarbon and has an average particle size within the range from 5 to 1000 mμ; or (ii) a solid prepared by dissolving an oil-soluble transition metal compound in an oil or emulsifying an aqueous solution of a water-soluble transition metal compound in an oil; dispersing an ultra-fine particle having an average particle size within the range of from 5 to 1000 mμ in the oil solution or in the oil/aqueous emulsion; and converting the dispersion at the to a solid by heating the dispersion at the decomposition temperature of the transition metal compound in the presence of a hydrogen gas or a hydrogen sulfide-containing hydrogen gas; or (iii) a solid prepared by dissolving an oil-soluble transition metal compound in an oil or dissolving a water-soluble transition metal compound in water; and converting the solution to a dry solid by spraying the solution in a hydrogen gas or a hydrogen sulfide-containing hydrogen gas in which an ultra-fine particle having an average particle size within the range from 5 to 1000 mμ is dispersed and by simultaneously heating the gas to decompose the transition metal compound and to dry the solid;

(B) thermally cracking the heavy hydrocarbon in the presence of a hydrogen gas or a hydrogen sulfide-containing hydrogen gas and recovering the resulting lighter hydrocarbon oil;

(C) removing a fraction having a high boiling point from the lighter hydrocarbon oil;

(D) hydrotreating a fraction having a low boiling point under hydrogenation conditions and recovering the resulting hydrotreated oil; and (E) pyrolyzing the hydrotreated oil or a mixture of the hydrotreated oil and a petroleum fraction with steam, and recovering a gaseous olefins product and a monocyclic aromatics product.

According to a third embodiment of the process, in the process according to the first or second embodiment as defined above, the whole or a part of a solid which is separated and recovered from the lighter hydrocarbon oil obtained in step (B) or the fraction having a high boiling point removed in step (C) is recycled to step (B).

According to a fourth embodiment of the process, in the process according to the first or second embodiment as defined above, the whole or a part of the fraction having a high boiling point removed in step (C) is recycled to step (B).

Thus, the process for producing gaseous olefins and monocyclic aromatics according to the present invention comprises as the basic steps four or five steps. In the case of the four steps, it is consisted of the step of adding to a heavy hydrocarbon at least two kinds of substances, the thermal cracking step, the step of removing a high boiling fraction and the steam pyrolysis step. In the case of the five steps, it has the hydrotreating step between the step of removing a high boiling fraction and the steam pyrolysis step.

The thermal cracking step employs the process for converting a heavy hydrocarbon into lighter, more valuable product as described above. Accordingly, through the effect of at least two kinds of substances to be added to the feedstock of a heavy hydrocarbon in the presence of hydrogen gas or hydrogen sulfide-containing hydrogen gas, the side reactions of polycondensation reaction and cokes formation reaction can be inhibited, and also scaling (coking) in the equipment particularly in the reaction zone can be prevented, whereby useful lighter oil can be obtained from a heavy hydrocarbon economically, stably and at high yield, with additional great advantage that deterioration of properties of the lighter oil as well as the high boiling residue can be prevented. This can be exhibited particularly in the case of using an atmospheric residue or a vacuum residue of a paraffin-based crude oil such as Minus crudes, Taching crudes, etc. known as the heavy oil crudes. More specifically, these heavy residues are heavy oils which have been deemed to be relatively difficult in high conversion to lighter, valuable product by phase separation of product. According to the present invention, by taking advantage of the excellent feature of paraffinic properties of these heavy oils, it is rendered possible to effect high conversion thereof into lighter, more valuable product. Accordingly, the fraction having the low boiling point of lighter product obtained by atmospheric or vacuum distillation can be provided for use directly in steam pyrolysis without further passing through the hydrotreating step to give starting materials for petroleum chemistry. As a consequence, equipments such as hydrotreating equipment are no more necessary, and there is also a great effect of decreased amount of hydrogen consumption. Moreover, the high boiling residue removed by distillation can sufficiently be utilized as the liquid fuel substantially similarly as the straight heavy oils for the fuel source in practicing the present process or boilers in general.

The steps of removing a high boiling fraction is required for feeding a fraction having a low boiling point to the subsequent steam pyrolysis steps or hydrotreating step. As the method for removing a high boiling fraction, there may employed high pressure gas separation, atmospheric distillation or vacuum distillation conventionally used, and further solvent deasphalting. It is also possible to effect fractionation into naphtha fraction (boiling point lower than 200° C.), kerosene gas oil fraction (boiling point of 200°-343° C.) and vacuum gas oil fraction (boiling point of 343°-545° C.). Various kinds of these lighter fractions may be subjected to steam pyrolysis as such or after hydrotreatment.

In subjecting the thermally cracked oil after removal of the high boiling fraction to be hydrotreating step, the method for hydrotreatment as described above can be employed as such. However, since the feedstock oil employed is the thermally cracked oil from which the toxic materials for the catalyst such as asphaltenes and metals have been removed, the catalyst employed has greater activity as the surface area as the physical property of porous carrier is greater, whereby it is not particularly required to increase the pore volume of large pore sizes as in the case of the catalyst for treatment of an oil with a high level content of asphaltenes or metals.

The thermally cracked oil from which the high boiling fraction has been separated and removed in the separating step or the hydrotreated oil recovered from the hydrotreating step may be used as the feedstock oil in the steam pyrolysis step, and it is also possible to carry out steam pyrolysis of each fraction fractionated separately or as a mixture with other petroleum fractions depending on the purpose.

The mode of steam pyrolysis to be used in the steam pyrolysis step in the process of the present invention is not particularly limited, but various modes can be employed, and it is also possible to use a tubular heater which is an existing naphtha cracking heater as such or with a slight modification.

The reaction conditions in the steam pyrolyzing step may be a steam oil weight ratio of 0.2 to 2.0, preferably 0.4 to 1.5, a pyrolysis temperature of 700° to 900° C., preferably 750° to 900° C., and a residence time of 0.05 to 2.0 seconds, preferably 0.1 to 0.6 seconds.

The product obtained by the steam pyrolysis reaction is led from the heater to a quenching heat exchanger for heat recovery, followed by separation and purification, to give gaseous olefins and monocyclic aromatics, by-produced fuel oils and other by-produced hydrogen and hydrocarbons.

In practicing the process of the present invention, hydrogen gas to be used in the thermal cracking step, and the hydrotreating step may be supplied by circulation from the hydrogen gases separated from the respective steps, sometimes after removal of hydrogen sulfide and ammonia contained therein, and it is generally desirable to supplement hydrogen gas in an amount corresponding to the hydrogen gas consumed. In this case, as hydrogen source, the hydrogen gas by-produced in steam pyrolysis or hydrogen gas obtained in steam modification of by-produced hydrocarbon gas or by-produced fuel oil may also be available.

Referring now to the accompanying drawings, the embodiments of the process for producing gaseous olefins and monocyclic aromatics by use of a heavy hydrocarbon as the feedstock in the present invention is described in detail, but the present invention is not limited thereby.

Figure 2:
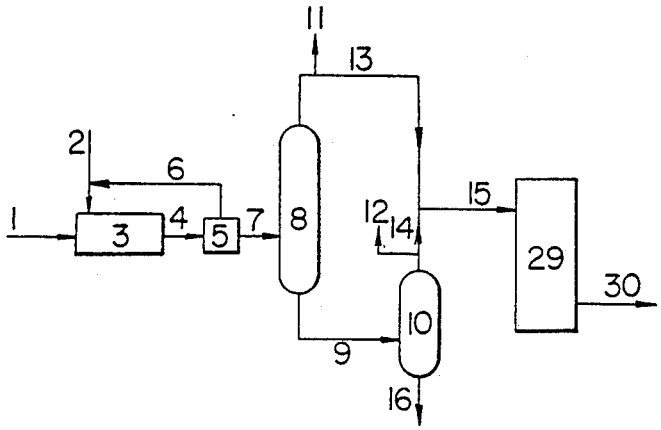

FIG. 1 and FIG. 2 show different examples of flow charts for practicing the process for producing gaseous olefins and monocyclic aromatics according to the present invention. To describe with reference to the steps in FIG. 1, the feedstock of a heavy hydrocarbon admixed with at least two kinds of substances according to the present invention is elevated in pressure by means of a feed pump and fed through a line 1, and hydrogen gas or hydrogen sulfide-containing gas is elevated in pressure by means of a compressor and fed through a line 2, respectively, into a thermal cracking equipment 3, wherein the heavy hydrocarbon is converted to lighter, more valuable product. The lighter product obtained is delivered through a line 4, to be quenched therein, to a gas-liquid separator 5. The high pressure gas-liquid separator consists generally of the two stages of a hot separator and a cold separator. The hydrogen-enriched gas from the separator is discharged through a line 6 and after elevation to a desired pressure, if desired, circulated to the thermal cracking equipment 3. The liquids from the hot separator and the cold separator are not required to be preheated and fed through a line 7 to an atmospheric flusher 8. Next, the atmospheric residue withdrawn through a withdrawing pipe 9 from the bottom of the atmospheric flusher 8 is further delivered to a vacuum flusher 10 to be treated therein. The vacuum flusher 10 is operated under vacuum with equipment of a vacuum generating device for the purpose of lowering the operating temperature, and sometimes it is also possible to use steam distillation as auxiliary means in which steam is blown from the tower bottom to lower the partial pressure of the oil. The atmospheric fraction from the atmospheric flusher 8 and the vacuum fraction from the vacuum flusher 10, after removal of off-gas through lines 11 and 12, respectively, are mixed by passing through lines 13 and 14 to be introduced into a line 15. On the other hand, the vacuum residue withdrawn through a withdrawing pipe 16 from the bottom of the vacuum flusher 10 may be employed as such as a liquid fuel, but it may be introduced into a solid separator 17 to be subjected to the solid separation operation. The solid separator 17 may comprise, for example, a centrifugal separator, a filter, a solvent sedimentor and a combination thereof. A part of the vacuum residue or the solid or the solid subjected to further cleaning and drying operations (not shown) may be recycled via the line 18 to be added to the feedstock of heavy hydrocarbon. The liquid vacuum residue separated from most of the solid in the solid separator 17 is discharged through a line 19 and may be used as liquid fuel. The distillate oil introduced into the line 15 is elevated in pressure by a feeding pump and fed into a hydrotreating equipment 20 to be hydrotreated therein with hydrogen gas elevated in pressure by means of a compressor. The hydrotreated product is cooled to a desired temperature by means of a heat-exchanger, etc. and delivered via a line 22 to a high pressure gas-liquid separator 23 to be separated into gas and liquid. The hydrogen-enriched gas separated is circulated via a line 24, after elevation to a desired pressure, by a compressor 21, if necessary, to the hydrotreating equipment 20. On the other hand, the hydrotreated liquid product is dropped in pressure by passing through a line 25 to be fed into a gas-liquid separator, and, after discharging the off-gas with a high vapor pressure through a line 27, delivered via a line 28 to a steam pyrolysis equipment 29. In this equipment, the hydrotreated product is steam pyrolyzed and the pyrolyzed product is withdrawn through a line 30, cooled, separated, purified and recovered as gaseous olefins, monocyclic aromatics, by-produced hydrogen, by-produced fuel oil, etc.

The flow chart shown in FIG. 2 shows the case when no hydrotreating step is required, corresponding to the chart shown in FIG. 1 from which the symbols 20 to 28 are omitted.

The present invention is described in further detail by referring to the following Examples, by which the present invention is not limited.

EXAMPLE 1

Using a vacuum residue of Minus crudes (100 wt. % of a fraction having boiling point higher than 520° C.) as the feedstock oil, thermal cracking was carried out by means of a continuous type equipment operated with high pressures having a reactor of a soaker type vessel of 40 mm in inner diameter and 100 mm in height equipped with a stirrer mounted with three turbine type blades each having three fans. As the two kinds of the components to be added to the feedstock oil, nickel octoate was added in an amount of 200 ppm as nickel based on the feedstock oil, and oil furnace carbon blacks [average particle size of 20 mμ by electron microscope (E.M.), specific surface area of 120 $m^2/g$ by BET method] in an amount of 2 wt. % based on the feedstock oil, respectively, and the feedstock oil was thoroughly stirred before it was fed into the reactor.

The reaction conditions employed for the thermal cracking were a temperature of 495° C., a pressure of 200 kg/cm$^2$, a residence time (based on cold liquid) of 20 minutes and a hydrogen/feedstock oil ratio of 2000 Nl/l, with the number of revolutions of the stirrer being 1000 rpm. The continuous running time was 100 hours as the steady state running time.

The products obtained were 5.8 wt. % of $C_1$–$C_4$ gases, 45.2 % of the GO− fraction by atmospheric distillation (b.p.: 343° C.>), 29.0 wt. % of the VGO fraction by vacuum distillation (b.p. 343°–520° C.) and 20.0 wt. % of the vacuum residue (VR). The content of asphaltenes idefined as insoluble in hexane and soluble in tetrahydrofuran) was 2.1 wt. %, and the content of cokes (defined as insoluble in both tetrahydrofuran and hexane) was 1.0 wt. %. The amount of hydrogen consumed was 110 Nl per kg of the feedstock. The conversion of heavy feedstocks into lighter, more valuable product as defined by the following formula:

$$\left(1 - \frac{\text{proportion of fraction having b.p. higher than 520° C. in product}}{\text{proportion of fraction having b.p. higher than 520° C. in feedstock}}\right) \times 100$$

was found to be 80 wt. %. The yield of the liquid fraction converted to lighter product of b.p. lower than 520° C. was 74.2 wt. % as the sum of GO− and VGO.

In addition, the amount of coking (scaling amount) on the inner wall surface of the reactor after 100 hours of steady state running was extremely small as 40 ppm based on the total weight of the feedstock oil fed.

COMPARATIVE EXAMPLE 1

Example 1 was repeated except that the two kinds of components were not added into the feedstock oil. As the result, about 2 hours after initiation of running, the reactor was completely plugged with coking, whereby no stable running could be practiced. Under the conditions where stable running was possible, the yield of the liquid fraction having b.p. lower than 520° C. was 34.1 wt. %, being less than half of the yield in Example 1.

COMPARATIVE EXAMPLE 2

Example 1 was repeated except that no ultrafine particle was added and only nickel octoate was added in an amount of 500 ppm as nickel. As the result, about 4 hours after initiation of running, the reactor was completely plugged with coking. The yield of the liquid fraction having b.p. lower than 520° C. was 75 wt. %, but the amount of cokes formed was 3.5 wt. % and most of them, namely about 3.0 wt. % was found to participate in the coking in the reactor.

COMPARATIVE EXAMPLE 3

Example 1 was repeated except that no transition metal compound was added and only oil furnace carbon blacks were added in an amount of 4 wt. %. As the result, about 15 hours after initiation of running, the reactor was completely plugged with coking. The yield of the liquid fraction having b.p. lower than 520° C. was 74 wt. %, but the amount of the cokes formed was as much as 6.1 wt. with the amount of coking in the reactor being about 0.8 wt. %.

COMPARATIVE EXAMPLE 4

Example 1 was repeated except that 3 wt. % of pulverized delayed cokes uniformized to have a particle size distribution within the range from about 10 to 60μ were employed instead of carbon blacks. As the result, about 3 hours after initiation of running, the reactor was completely plugged with coking. The yield of the liquid fraction having b.p. lower than 520° C. was 73 wt. %, but the amount of cokes formed was 3.1 wt. %, of which about 2.2 wt. % was found to have undergone coking together with the pulverized delayed cokes added in the reactor.

COMPARATIVE EXAMPLE 5

Example 1 was repeated except that 3 wt. % of nickel-tungsten catalyst supported on porous Γ-alumina with a specific surface area of 220 m$^2$/g (BET method) containing 4 wt. % of nickel oxide and 15 wt. % of tungsten oxide, pulverized to particles sizes of 60μ or less, was employed instead of nickel octoate and carbon blacks. As the result, after running for about 7 hours, the reactor was completely plugged and stable running could be continued no longer. The yield of the liquid fraction having b.p. lower than 520° C. was 72 wt. % and the amount of cokes formed was 1.8 wt. %, but within the reactor, about 1.2 wt. % of the cokes was found to have undergone coking in the form containing partially the catalyst added.

COMPARATIVE EXAMPALE6

Example 1 was repeated except that an aqueous solution of ammonium molybdenate dissolved in water was added in an amount of 500 ppm as molybdenum into the feedstock oil to form an emulsion, to which were further added 3 wt. % of pulverized particles of about 10μ to 30μ of a complex oxide of silica-alumina (silica 60%, alumina 40%) which was a porous material with a specific surface area of 400 m$^2$/g (BET method) instead of nickel octoate and carbon blacks. As the result, after running for about 10 hours, the reactor was completely plugged and stable running could be continued no longer. The yield of the liquid fraction having b.p. lower than 520° C. was 75 wt. % and the amount of cokes formed was 3.5 wt. %, but within the reactor, about 1.2 wt. % of the cokes was found to have undergone coking in the form containing partially the particulate material added.

As apparently seen from the results of Example 1 and Comparative examples 1 through 6, the present invention can be appreciated to be excellent as the method for obtaining a high yield of lighter oil by cracking of a heavy hydrocarbon. Moreover, the residual oil having b.p. higher than 520° C. obtained in the present invention has a viscosity as low as 22 cst at 150° C., and its combustibility by thermogravimetric analysis is similar to the vacuum residue of the feedstock Minus crudes, and thus it was sufficiently available as fuel oil.

EXAMPLES 2–10

Using a vacuum residue of Minus crudes (100 wt. % of the fraction having b.p. higher than 520° C.) as the feedstock oil, various combinations of two kinds of components were added thereto in predetermined amounts as mentioned below to carry out thermal cracking by means of the same reaction apparatus as in Example 1.

That is, in the case of Example 2, vanadium octoate was added in an amount of 300 ppm as vanadium and channel carbon black [average particle size: 14 mμ (E.M. method), specific surface area: 300 m$^2$/g (BET method)] was added in an amount of 2 wt. %, respectively.

In the case of Example 3, copper octoate was added in an amount of 500 ppm as copper and silicas produced by liquid-phase process [average particle size: 20 mμ (E.M. method), specific surface area: 150 $m^2/g$ (BET method)] was added in an amount of 2 wt. %, respectively.

In the case of Example 4, molybdenum naphthenate was added in an amount of 100 ppm as molybdenum and silicas produced by vapor-phase processes [average particle size: 8 mμ (E.M. method), specific surface area: 350 $m^2/g$ (BET method)] was added in an amount of 1 wt. %, respectively.

In the case of Example 5, an aqueous solution of ammonium heptatungstate was added in an amount of 600 ppm as tungsten and an alumina produced by vapor-phase process [average particle size: 20 mμ (E.M. method), specific surface area: 100 $m^2/g$ (BET method)] was added in an amount of 3 wt. %, respectively.

In the case of Example 6, an aqueous solution of cobalt sulfate was added in an amount of 800 ppm as cobalt and an anatase type titanium oxide produced by vapor-phase process [average particle size: 30 mμ (E.M. method), specific surface area: 50 $m^2/g$ (BET method)] was added in an amount of 6 wt. %, respectively.

In the case of Example 7, nickel stearate was added in an amount of 300 ppm as nickel and calcined cokes micropulverized by a jet crusher [average particle size: 400 mμ (E.M. method), specific surface area: 35 $m^2/g$ (BET method)] was added in an amount of 10 wt. %, respectively.

In the case of Example 8, chromium resinate was added in an amount of 700 ppm as chromium and thermal decomposition carbon black [average particle size: 180 mμ (E.M. method), specific surface area: 15 $m^2/g$ (BET method)] was added in an amount of 7 wt. %, respectively.

In the case of Example 9, nickel acetylacetonate was added in an amount of 500 ppm as nickel and fluid cokes micropulverized by a jet crusher [average particle size: 800 mμ (E.M. method), specific surface area: 25 $m^2/g$ (BET method)] was added in an amount of 10 wt. %, respectively.

In the case of Example 10, iron pentacarbonyl was added in an amount of 1000 ppm as iron and silicates produced by liquid-phate processes (containing 18% of calcium oxide) [average particle size: 30 mμ (E.M. method), specific surface area: 80 $m^2/g$ (BET method)] was added in an amount of 3 wt. %, respectively.

In Examples 7 and 9, each 1 wt. % of a dispersant composed primarily of calcium petroleum sulfonate and a dispersant composed primarily of polybutenylsuccinimide was further added to the feedstock oil, respectively.

The reaction conditions employed for thermal cracking were a temperature of 495° C., a pressure of 200 $kg/cm^2$, a residence time (based on cold liquid) of 20 minutes and the number of revolutions of the stirrer of 1000 rpm in all Examples 2 to 10, a hydrogen/feedstock oil ratio of 2000 Nl/l in Examples 2 to 7, and a hydrogen with 3 mol % of hydrogen sulfide/feedstock oil ratio of 2000 Nl/l in Examples 8 to 10. The steady state running for each Example was 30 hours.

As the result of the experiment, in all these Examples, stable running was possible without causing plugging of the reactor, with the conversion being within the range from 75 to 85 wt. % and the yield of the liquid fraction boiling at lower than 520° C. being within the range from 70 to 78 wt. %. In addition, the amount of cokes formed was within the range from 0.7 to 2 wt. %, and the amount of coking on the inner wall surface in the reactor was within the range from 40 to 200 ppm based on the total weight of the feedstock fed.

EXAMPLE 11

An Arabian light vacuum gas oil (b.p. 343°-520° C.) containing 1000 ppm as nickel of nickel stearate and 10 wt. % of oil furnace carbon black [average particle size: 15 mu (E.M. method), specifid surface area 200 $m^2/g$] was charged in an amount of 3 kg into an autoclave of an inner volume of 10 liter, hydrogen gas containing 5 mole % of hydrogen sulfide was pressurized into the autoclave at a charging pressure of 100 $kg/cm^2$ and the reaction was carried out under stirring at 1000 rpm at a temperature of 420° C. for one hour. After the reaction, the contents were filtered, washed and extracted with tetrahydrofuran, followed by drying to obtain a solid product. The solid product was added to a vacuum residue of Minus crudes dissolved by heating (100 wt. % of the fraction having b.p. higher than 520° C.) to a content of 10 wt. % and dispersed highly therein by ultrasonic wave. The resultant dispersion was added to the same Minus vacuum residue as mentioned above to a solid content of 2 wt. %. The mixture was thoroughly stirred and provided for use in steady state running of the reaction conducted by the same reaction apparatus and under the same conditions as in Example 1 for 30 hours.

As the result of the experiment, running could be accomplished stably without causing plugging of the reactor, with the conversion being 81.6 wt. % and the yield of the liquid fraction obtained having b.p. lower than 520° C. being 75.6 wt. %. The amount of the cokes formed was 0.8 wt. % and the amount of coking on the inner wall surface of the reactor was 40 ppm based on the total weight of the feedstock fed.

EXAMPLE 12

Silicas produced by vapor-phase processes [average particle size: 16 mμ (E.M. method), specific surface area: 200 $m^2/g$ (BET method)] (300 g) was suspended in hydrogen gas containing 5 mole % of hydrogen sulfide in a fluidized bed and, while being permitted to fly with rotation through the gas stream, subjected to atomizing mixing with an aqueous solution of ammonium heptamolybdate in an amount of 15 g as molybdenum. Then, while maintaining the temperature of the gas stream at 430° C., the reaction was carried out for one hour. The solid product obtained by this procedure was added to the vacuum residue of Minus crudes (100 wt. % of the fraction having b.p. higher than 520° C.) to a content of 2 wt. %, and the feedstock oil was thoroughly stirred and fed to the reactor. The reaction apparatus and the reaction conditions were the same as in Example 1, and the steady state running conducted for 20 hours.

As the result of the experiment, running could be accomplished stably without causing plugging of the reactor, with the conversion being 80.9 wt. % and the yield of the liquid fraction obtained having b.p. lower than 520° C. being 74.9 wt. %. The amount of the cokes formed was 1.2 wt. % and the amount of coking on the inert wall surface of the reactor was 95 ppm based on the total weight of the feedstock fed.

EXAMPLE 13

The product oil obtained in Example 1 was subjected to atmospheric distillation and vacuum distillation to remove the fraction boiling at lower than 520° C. The resultant residue was filtered under heating. The solid residue after extraction of the filtered product with tetrahydrofuran was dried and added to a vacuum residue of Minus crudes (100 wt. % of the fraction having b.p. higher than 520° C.) to 4 wt. %, followed by addition of 0.5 wt. % of a dispersant composed primarily of calcium petroleum sulfonate. The mixture was thoroughly stirred and fed into the reactor. The reaction apparatus and the reaction conditions were the same as in Example 1, and the steady state running conducted for 30 hours.

As the result of the experiment, running could be accomplished stably without causing plugging of the reactor, with the conversion being 81.8 wt. % and the yield of the liquid fraction obtained having b.p. lower than 520° C. being 75.4 wt. %. The amount of the cokes formed was 1.6 wt. % and the amount of coking on the inner wall surface of the reactor was 140 ppm based on the total weight of the feedstodk fed.

EXAMPLE 14

The product oil obtained in Example 1 was subjected to atmospheric distillation and vacuum distillation to remove the fraction having b.p. lower than 520° C. The resultant residue was added to a vacuum residue of Minus crudes (100 wt. % of the fraction having b.p. higher than 520° C.) to 4 wt. %, followed by addition of molybdenum naphthenate in an amount of 500 ppm as molybdenum based on the feedstock oil and further by addition of 0.5 wt. % of silicas produced by vapor-phase processes [average particle size: 8 mμ (E.M. method), specific surface area: 350 $m^2/g$ (BET method)] to the feedstock oil. The mixture was thoroughly stirred and fed into the reactor. The reaction apparatus and the reaction conditions were the same as in Example 1, and the steady state running conducted for 30 hours.

As the result of the experiment, running could be accomplished stably without causing plugging of the reactor, with the conversion being 74.8 wt. % and the yield of the liquid fraction obtained having b.p. lower than 520° C. being 69.7 wt. %. The amount of the cokes formed was 2.0 wt. % and the amount of coking on the inner wall surface of the reactor was 180 ppm based on the total weight of the feedstock fed.

EXAMPLE 15

Using a vacuum residue of Taching crudes (100 wt. % of the fraction having b.p. higher than 520° C.) as the feedstock oil, thermal cracking was conducted by means of the same continuous type equipment operated with high pressures as used in Example 1.

As the components to be added to the feedstock oil, copper naphthenate was added in an amount of 500 ppm as copper and silicas produced by liquid-phase processes [average particle size: 15 mμ (E.M. method), specific surface area: 210 $m^2/g$ (BET method)] was added to a content of 2 wt. %. The feedstock was thoroughly stirred before feeding to the reactor.

The reaction conditions employed for thermal cracking were a temperature of 490° C., a pressure of 150 $kg/cm^2$, a residence time (based on cold liquid) of 20 minutes and a hydrogen/feedstock oil ratio of 2000 Nl/l, with the number of revolutions of the stirrer being 1000 rpm. The steady state running was continued for 50 hours.

As the result of the experiment, running could be accomplished stably without causing plugging of the reactor, with the conversion being 81.4 wt. % and the yield of the liquid fraction obtained having b.p. lower than 520° C. being 76.0 wt. %. The amount of the cokes formed was 1.4 wt. % and the amount of coking on the inner wall surface of the reactor was 20 ppm based on the total weight of the feedstock fed. The amount of hydrogen consumed was found to be 100 Nl/kg-feedstock.

EXAMPLE 16

Using a vacuum residue of Arabian light crudes (100 wt. % of the fraction having b.p. higher than 520° C.) as the feedstock oil, thermal cracking was conducted by means of the same continuous type equipment operated with high pressures as used in Example 1.

As the components to be added to the feedstock oil, vanadium acetylacetonate was added in an amount of 500 ppm as vanadium and further silicas produced by vapor-phase processes [average particle size: 12 mμ (E.M. method), specific surface area: 230 $m^2/g$ (BET method)] was added to a dontent of 3 wt. %. The feedstock was thoroughly stirred before feeding to the reactor.

The reaction conditions employed for thermal cracking were a temperature of 480° C., a pressure of 200 $kg/cm^2$, a residence time (based on cold liquid) of 25 minutes and a hydrogen/feedstock oil ratio of 2000 Nl/l, with the number of revolutions of the stirrer being 1000 rpm. The steady state running was continued for 100 hours.

As the result of the experiment, running cold be accomplished stably without causing plugging of the reactor, with the conversion being 74.7 wt. % and the yield of the liquid fraction obtained having b.p. lower than 520° C. being 68.9 wt. %. The amount of the cokes formed was 1.0 wt. % and the amount of coking on the inner wall surface of the reactor was 200 ppm based on the total weight of the feedstock fed. The amount of hydrogen consumed was found to be 170 Nl/kg-feedstock.

EXAMPLE 17

Using a vacuum residue of Venezuela crudes (100 wt. % of the fraction having b.p. higher than 520° C.) as the feedstock oil, thermal cracking was conducted by means of the same continuous type equipment operated with high pressures as used in Example 1.

As the components to be added to the feedstock oil, nickel naphthenate was added in an amount of 500 ppm as nickel and further silicas produced by liquid-phase processes [average particle size: 15 mμ (E.M. method), specific sufface area: 210 $m^2/g$ (BET method)] was added to a content of 2 wt. %. The feedstock was thoroughly stirred before feeding to the reactor.

The reaction conditions employed for thermal cracking were a temperature of 485° C., a pressure of 200 $kg/cm^2$, a residence time (based on cold liquid) of 25 minutes and a hydrogen/feedstock oil ratio of 2000 Nl/l, with the number of revolutions of the stirrer being 1000 rpm. The steady state running was continued for 20 hours.

As the result of the experiment, running could be accomplished stably without causing plugging of the reactor, with the conversion being 78.2 wt. % and the yield of the liquid fraction obtained having b.p. lower than 520° C. being 71.9 wt. %. The amount of the cokes formed was 2.8 wt. % and the amount of coking on the inner wall surface of the reactor was 240 ppm based on the total weight of the feedstock fed. The amount of hydrogen consumed was found to be 190 Nl/kg-feedstock.

EXAMPLE 18

Using a vacuum residue of Maya crudes (100 wt. of the fraction having b.p. higher than 520° C.) as the feedstock oil, thermal cracking was conducted by means of the same continuous type equipment operated with high pressures as used in Example 1.

As the components to be added to the feedstock oil, nickel naphthenate was added in an amount of 500 ppm as nickel and further silicas produced by liquid-phase processes [average particle size: 15 mμ (E.M. method), specific surface area: 210 $m^2/g$ (BET method)] was added to a content of 2 wt. %. The feedstock was thoroughly stirred before feeding to the reactor.

The reaction conditions employed for thermal cracking were a temperature of 485° C., a pressure of 200 $kg/cm^2$, a residence time (based on cold liquid) of 25 minutes and a hydrogen/feedstock oil ratio of 2000 Nl/l, with the number of revolutions of the stirring being 1000 rpm. The steady state running was continued for 20 hours.

As the result of the experiment, running could be accomplished stably without causing plugging of the reactor, with the conversion being 75.4 wt. % and the yield of the liquid fraction obtained having b.p. lower than 520° C. being 68.1 wt. %. The amount of the cokes formed was 2.7 wt. % and the amount of coking on the inner wall surface of the reactor was 280 ppm based on the total weight of the feedstock fed. The amount of hydrogen consumed was found to be 220 Nl/kg-feedstock.

EXAMPLE 19

A mixture of all the product oils of Examples 1 to 5 and 10 to 14 was used as the feedstock oil. By means of a continuous type hydrotreating reaction apparatus of 18 mm $\phi$ inner diameter in which the fixed-bed reactor was packed with Ni-Mo/Al catalyst with a surface area of 270 $m^2/g$ and a porosity of 0.75 ml/g containing 5 wt. % of nickel oxide and 20 wt. % of molybdenum oxide, after application of presulfiding on the catalyst, hydrogenation was conducted under the reaction conditions of a hydrogen/feedstock oil ratio of 1000 Nl/l, a temperature of 400° C., a pressure of 180 $kg/cm^2$ and LHSV of 0.8 $hr^{-1}$. The properties of the feedstock oil and the hydrotreated oil recovered are shown in Table 1.

EXAMPLE 20

Using a fraction obtained by removing high boiling components having b.p. higher than 520° C. from the product oil in Example 1 by atmospheric distillation and vacuum distillation, as the feedstock oil, and Co-Mo/Al catalyst with a surface area of 240 $m^2/g$ and a porosity of 0.53 ml/g containing 4 wt. % of cobalt oxide and 14 wt. % of molybdenum oxide, applied with presulfiding, hydrotreatment was conducted by means of the same continuous type hydrotreating reaction apparatus as used in Example 19 under the reaction conditions of a hydrogen/feedstock oil ratio of 1000 Nl/l, a temperature of 390° C., a pressure of 150 $kg/cm^2$ and LHSV of 1.0 $hr^{-1}$. The properties of the feedstock oil and the hydrotreated oil recovered are shown in Table 1.

EXAMPLE 21

Using a fraction obtained by removing high boiling components having b.p. higher than 520° C. from the product in Example 16 by atmospheric distillation and vacuum distillation, as the feedstock oil, and Ni-Mo/Al catalyst with a surface area of 230 $m^2/g$ and a porosity of 0.60 m/g containing 4 wt. % of nickel oxide and 14 wt. % of molybdenum oxide, applied with presulfiding, hydrotreatment was conducted by means of the same continuous type hydrotreatment reaction apparatus as used in Example 19 under the reaction conditions of a hydrogen/feedstock oil ratio of 1000 Nl/l, a temperature of 400° C., a pressure of 200 $kg/cm^2$ and LHSV of 0.8 $hr^{-1}$. The properties of the feedstock oil and the hydrotreated oil recovered are shown in Table 1.

TABLE 1

| | Changes in Oil Properties by Hydrotreatment | | | | | |
|---|---|---|---|---|---|---|
| | Example 19 | | Example 20 | | Example 21 | |
| | Feed-stock | Hydro-treated oil | Feed-stock | Hydro-treated oil | Feed-stock | Hydro-treated oil |
| Specific gravity (15/4° C.) | 0.8490 | 0.8100 | 0.8327 | 0.8048 | 0.8703 | 0.8358 |
| H/C (atomic ratio) | 1.79 | 1.95 | 1.88 | 1.99 | 1.69 | 1.92 |
| Sulfur content (wt. %) | 0.05 | trace | 0.02 | trace | 2.31 | 0.01 |
| Nitrogen content (wt. %) | 0.12 | 0.05 | 0.05 | 0.02 | 0.06 | 0.01 |
| Conradson carbon residue (wt. %) | 6.40 | 0.02 | 0.07 | trace | 0.15 | trace |
| Type analysis (column chromatography) | | | | | | |
| Saturated component (wt. %) | 75.0 | 91.5 | 79.3 | 93.0 | 55.2 | 91.1 |
| Aromatic component (wt. %) | 18.9 | 8.3 | 15.7 | 6.9 | 39.4 | 8.4 |
| Polar components (wt. %) | 6.1 | 0.2 | 5.0 | 0.1 | 5.4 | 0.5 |
| Hydrogen distribution (H—NMR) | | | | | | |
| Aromatic hydrogen (%) | 3.9 | 1.1 | 3.2 | 1.0 | 6.1 | 1.3 |
| Olefinic hydrogen (%) | 1.1 | trace | 1.0 | trace | 1.4 | trace |
| Aromatic α-position hydrogen (%) | 6.0 | 4.8 | 5.8 | 4.8 | 12.8 | 7.2 |
| Methylene hydrogen (%) | 66.4 | 69.3 | 65.8 | 69.5 | 55.5 | 66.4 |
| Methyl hydrogen (%) | 22.6 | 25.0 | 24.2 | 24.7 | 24.2 | 25.1 |

EXAMPLE 22

From the thermally cracked product removed of the gaseous components obtained in Example 1 using the vacuum residue of Minus crudes as the feedstock, the high boiling components having b.p. higher than 520° C. were removed according to atmospheric and vacuum distillation.

The fraction boiling at lower than 520° C. was steam pyrolyzed by means of a tubular heater type pyrolyzer under the conditions of an inlet temperature of 550° C., an outlet temperature of 830° C., an outlet pressure of 0.8 kg/cm$^2$G, a steam oil weight ratio of 1.0 and a residence time of 0.2 seconds to obtain olefins and monocyclic aromatics.

The results of the steam pyrolysis are given together with the yields of the main chemical starting materials (main gaseous olefins and monocyclic aromatics) per feedstock of the vacuum residue of Minus crudes in Table 2.

EXAMPLE 23

The hydrotreated oil removed of the gaseous components obtained in Example 20 using the Minus vacuum residue as the starting material was subjected to steam pyrolysis similarly as in Example 22 under the conditions of an inlet temperature of 550° C., an outlet temperature of 830° C., an outlet pressure of 0.8 kg/cm$^2$G, a steam/hydrotreated oil weight ratio of 1.0 and a residence time of 0.2 seconds to obtain olefins and monocyclic aromatics.

The results of the steam pyrolysis are given together with the yields of the main chemical starting materials (main gaseous olefins and monocyclic aromatics) per feedstock in Table 2.

COMPARATIVE EXAMPLE 7

The thermally cracked product obtained in stable running in Comparative example 1, from which the gaseous components were removed, was subjected to atmospheric and vacuum distillation in the separation step, and the fraction boiling at lower than 520° C. was applied with the procedure of hydrotreating step and steam pyrolysis step similarly as in Example in 20 and 23, respectively.

The results of the steam pyrolysis are shown together with the yields of the main chemical starting materials (main gaseous olefins and monocyclic aromatics) in Table 2.

COMPARATIVE EXAMPLE 8

The thermal cracking step was practiced by using a vacuum residue of Minus crudes as the feedstock oil, the same hydrotreating apparatus as in Example 19, Ni-W catalyst on 70 wt. % silica/30 wt. % alumina with a surface area of 230 m$^2$/g and a porosity of 0.37 ml/g containing 6 wt. % of nickel oxide and 19 wt. % of tungsten oxide, and also employing the conditions under which the catalyst activity deterioration is not marked in initiation of running, namely a temperature of 380° C., a reaction pressure of 200 kg/cm$^2$G, LHSV of 0.5 hr$^{-1}$ and a hydrogen/feedstock oil ratio of 2000 Nl/l. The yield of the liquid fraction boiling at lower than 520° C. was only 16.5 wt. %. The resultant liquid fraction was subjected to the same steam pyrolysis as in Example 22. The results of the steam pyrolysis are given together with the yields of the main chemical starting materials (main gaseous olefins and monocyclic aromatics) per feedstock in Table 2.

As apparently seen from the results in Examples 22 and 23 and Comparative examples 7 and 8, the method of the present invention can be appreciated to be excellent as the method for decomposing heavy hydrocarbons to give starting materials to be supplied for steam pyrolysis, thus providing high yields of petrochemical starting materials.

EXAMPLE 24

From the thermally cracked product removed of the gaseous components obtained in Example 15 using the vacuum residue of Taching crudes as the feedstock, the high boiling components having b.p. higher than 520° C. were removed according to atmospheric and vacuum distillation.

The fraction boiling at lower than 520° C. was steam pyrolyzed by means of a tubular heater type pyrolyzer under the conditions of an inlet temperature of 550° C., an outlet temperature of 830° C., an outlet pressure of 0.8 kg/cm$^2$G, a steam oil weight ratio of 1.0 and a residence time of 0.2 seconds to obtain olefins and monocyclic aromatics.

The results of the steam pyrolysis are given together with the yields of the main chemical starting materials (main gaseous olefins and monocyclic aromatics) per feedstock in Table 2.

EXAMPLE 25

From the thermally cracked product removed of the gaseous components obtained in Example 16 using the vacuum residue of Arabian light crudes as the feedstock, the high boiling components having b.p. higher than 520° C. were removed by separation according to atmospheric and vacuum distillation.

The fraction boiling at lower than 520° C. was steam pyrolyzed by means of a tubular heater type pyrolyzer under the conditions of an inlet temperature of 550° C., an outlet temperature of 830° C., an outlet pressure of 0.8 kg/cm$^2$G, a steam oil weight ratio of 1.0 and a residence time of 0.2 seconds to obtain olefins and monocyclic aromatics.

The results of the steam pyrolysis are given together with the yields of the main chemical starting materials (main gaseous olefins and monocyclic aromatics) per feedstock in Table 2.

EXAMPLE 26

The hydrotreated oil removed of the gaseous components obtained in Example 21 using the vacuum residue of Arabian light crudes as the feedstock was steam pyrolyzed by means of a tubular heater type pyrolyzer under the conditions of an inlet temperature of 550° C., an outlet temperature of 830° C., an outlet pressure of 0.8 kg/cm$^2$G, a steam/hydrogenated oil weight ratio of 1.0 and a residence time of 0.2 seconds to obtain olefins and monocyclic aromatics.

The results of the final step of subjecting the hydrogenated oil to the steam pyrolysis are given together with the yields of the main chemical starting materials (main gaseous olefins and monocyclic aromatics) per feedstock in Table 2.

TABLE 2

| | | Results of Steam Pyrolysis and Yields of Main Chemical Starting Materials per Feedstock | | | | | | |
|---|---|---|---|---|---|---|---|---|
| | | Example 22 | Example 23 | Comparative example 7 | Comparative example 8 | Example 24 | Example 25 | Example 26 |
| Yield of Main Products (wt. %) | Hydrogen | 0.7 | 0.8 | 0.8 | 0.7 | 0.7 | 0.7 | 0.9 |
| | Methane | 10.4 | 10.6 | 10.6 | 9.1 | 9.7 | 9.0 | 11.0 |
| | Ethylene | 28.1 | 32.0 | 30.8 | 31.2 | 29.2 | 23.0 | 28.9 |
| | Propylene | 14.2 | 15.8 | 15.1 | 15.5 | 13.8 | 10.7 | 14.1 |
| | Butadiene | 5.1 | 7.4 | 6.8 | 7.0 | 6.1 | 5.0 | 7.2 |
| | Monocyclic aromatics ($C_6 \sim C_8$) | 11.1 | 12.4 | 9.8 | 13.2 | 10.2 | 8.6 | 14.7 |
| | Cracked gasoline ($C_5 \sim 200°$ C.) | 17.3 | 19.7 | 18.8 | 20.1 | 16.6 | 13.8 | 21.7 |
| | Heavy oil (higher than 200° C.) | 16.9 | 6.2 | 7.1 | 5.8 | 15.8 | 32.3 | 8.2 |
| Yield of main chemical starting materials (wt. %) (1) | | 58.5 | 67.6 | 62.5 | 66.9 | 59.3 | 47.3 | 64.9 |
| Yield of thermally cracked oil boiling at lower than 520° C. in the thermal cracking step (wt. %) (2) | | 74.2 | 74.2 | 34.1 | 16.5 | 76.0 | 68.9 | 68.9 |
| Yield of hydrotreated oil in the hydrotreating step (wt. %) (3) | | — | 99.3 | 99.5 | — | — | — | 99.0 |
| Yield of main chemical starting materials per feedstock (wt. %) (4) | | 43.4 | 49.8 | 21.2 | 11.0 | 45.1 | 32.6 | 44.3 |

Note
(1) Yield of main chemical starting materials = Ethylene yield + Propylene yield + Butadiene yield + Monocyclic aromatics ($C_6 \sim C_8$) yield
(4) Yield of main chemical starting materials per feedstock = (1) × (2) × (3)

EXAMPLES 27–30

The thermally cracked product obtained in Examples 11, from which the gaseous components were removed, in the case of Example 27, the thermally cracked product obtained in Examples 12, from which the gaseous components were removed, in the case of Example 28, the thermally cracked product obtained in Example 13, from which the gaseous components were removed, in the case of Example 29, the thermally cracked product obtained in Examples 14, from which the gaseous components were removed, in the case of Example 30, were each employed as the hydrocarbon oil converted to lighter products in the respective thermal cracking steps, and each oil was subjected to atmospheric and vacuum distillations in the respective separation steps for removal of the components having b.p. higher than 520° C.

Each of the hydrocarbon oils stripped of the high boiling components with b.p. higher than 520° C. was subjected to hydrotreatment similarly as in Example 20.

Each of the hydrotreated oil removed of gaseous components was subjected to steam pyrolysis similarly as in Example 22.

The results of the steam pyrolysis are given together with the yields of the main chemical starting materials (main gaseous olefins and monocyclic aromatics) per vacuum residue of Minus crudes which is the starting material in Table 3.

TABLE 3

| | | Results of Steam Pyrolysis and Yields of Main Chemical Starting Materials per Feedstock | | | |
|---|---|---|---|---|---|
| | | Example 27 | Example 28 | Example 29 | Example 30 |
| Yields of Main Products (wt. %) | Hydrogen | 0.7 | 0.7 | 0.8 | 0.8 |
| | Methane | 10.0 | 9.6 | 10.8 | 9.9 |
| | Ethylene | 33.2 | 33.8 | 31.0 | 32.1 |
| | Propylene | 16.2 | 16.1 | 15.2 | 16.0 |
| | Butadiene | 7.8 | 7.8 | 7.9 | 7.5 |
| | Monocyclic aromatics ($C_6 \sim C_8$) | 10.5 | 10.3 | 12.7 | 11.8 |
| | Cracked gasoline ($C_5 \sim 200°$ C.) | 17.9 | 16.6 | 18.5 | 19.3 |
| | Heavy oil (higher than 200° C.) | 7.5 | 6.5 | 8.0 | 7.7 |
| Yield of main chemical starting materials (wt. %) (1) | | 67.7 | 68.0 | 66.8 | 67.4 |
| Yield of thermally cracked oil boiling at lower than 520° C. in the thermal cracking step (wt. %) (2) | | 75.6 | 74.9 | 75.4 | 69.7 |
| Yield of hydrotreated oil in the hydrotreating step (wt. %) (3) | | 99.4 | 99.3 | 99.2 | 99.4 |
| Yield of main chemical starting materials per feedstock (wt. %) (4) | | 50.9 | 50.6 | 50.0 | 46.7 |

Note
(1) Yield of main chemical starting materials = Ethylene yield + Propylene yield + Butadiene yield + Monocyclic aromatics ($C_6 \sim C_8$) yield
(4) Yield of main chemical starting materials per feedstock = (1) × (2) × (3)

EXAMPLES 31 and 32

Using an atmospheric residue of Minus crudes (100 wt. % of fraction having b.p. higher than 343° C., 45 wt. % of fraction having b.p. higher than 520° C.) as the feedstock, thermal cracking was conducted by means of the same continuous type equipment operated with high pressures as in Example 1.

As the two kinds of the components to be added to the feedstock oil in thermal cracking, there were added molybdenum naphthenate in an amount of 100 ppm as molybdenum and oil furnace carbon black [average particle size: 15 mμ (E.M. method), specific surface area: 200 $m^2/g$ (BET method)] in an amount of 2 wt. %, respectively, in the case of Example 31; and an aqueous solution of ammonium molybdenate dissolved in water in an amount of 500 ppm as molybdenum to form an emulsion, to which was further added an alumina produced by the vapor-phase processes [average particle size: 20 mμ (E.M. method), specific surface area: 100 $m^2/g$ (BET method)] in an amount of 3 wt. in the case of Example 32.

The thermal cracking conditions were, in each case, a temperature of 490° C., a presence of 150 $kg/cm^2$, a residence time (based on cold liquid) of 18 minutes and a hydrogen/feedstock ratio of 1500 Nl/l, with the number of revolutions of the stirrer of 1000 rpm.

The thermally cracked products freed of gaseous components were each subjected to atmospheric and vacuum distillations in the respective separation step similarly as in Example 20 for removal of high boiling components with b.p. higher than 520° C., and the fraction boiling at lower than 520° C. was steam pyrolyzed to obtain olefins and monocyclic aromatics.

The results of steam pyrolysis of Example 31 and 32 are set forth in Table 4, together with the yields of the main chemical starting materials (main gaseous olefins and monocyclic aromatics).

EXAMPLES 33 AND 34

Using an atmospheric residue of Arabian light crudes (100 wt. % of fraction having b.p. higher than 343° C., 46 wt. % of fraction having b.p. higher than 520° C.) as the feedstock, thermal cracking was conducted by means of the same continuous type equipment operated with high pressures as in Example 1.

As the two kinds of the components to be added to the feedstock oil in thermal cracking, there were added iron pentacarbonyl in an amount of 800 ppm as iron and channel carbon black [average particle size: 14 mμ (E.M. method), specific surface area: 300 $m^2/g$ (BET method)] in an amount of 2 wt. %, respectively, in the case of Example 33; and cobalt resinate in an amount of 300 ppm as cobalt and thermal carbon black [average particle size: 80 mμ (E.M. method), specific surface area: 15 $m^2/g$ (BET method)] in an amount of 6 wt. % in the case of Example 34.

The thermal cracking conditions were, in each case, a temperature of 470° C., a pressure of 200 $kg/cm^2$, a residence time (based on cold liquid) of 30 minutes and a hydrogen/feedstock oil ratio of 2000 Nl/l, with the number of revolutions of the stirrer of 1000 rpm.

The thermally cracked products freed of gaseous components were each subjected to atmospheric and vacuum distillations in the respective separation step for removal of high boiling components with b.p. higher than 520° C.

Using the fraction boiling at lower than 520° C. obtained as the feedstock oil, hydrotreatment was conducted by means of the same continuous type hydrotreating reaction apparatus and fixed-bed catalyst as in Example 19 under the conditions of a hydrogen/feedstock oil ratio of 1000 Nl/l, a temperature of 395° C., a pressure of 180 $kg/cm^2$ and LHSV of 0.8 $hr^{-1}$.

The hydrotreated oil recovered was steam pyrolyzed by means of a tubular heater type pyrolyzer under the conditions of an inlet temperature of 550° C., an outlet temperature of 830° C., an outlet pressure of 0.8 $kg/cm^2G$, a steam/hydrogenated oil weight ratio of 1.0 and a residence time of 0.2 seconds to obtain olefins and monocyclic aromatics.

The results of steam pyrolysis of Examples 33 and 34 are set forth in Table 4, together with the yields of the main chemical starting materials (main gaseous olefins and monocyclic aromatics).

TABLE 4

Results of Steam Pyrolysis and Yields of Main Chemical Starting Materials per Feedstock

| | | Example 31 | Example 32 | Example 33 | Example 34 |
|---|---|---|---|---|---|
| Yields of Main Products (wt. %) | Hydrogen | 0.7 | 0.7 | 0.7 | 0.8 |
| | Methane | 10.3 | 10.1 | 11.3 | 11.6 |
| | Ethylene | 29.4 | 28.5 | 30.5 | 31.0 |
| | Propylene | 14.9 | 15.0 | 16.7 | 14.7 |
| | Butadiene | 5.2 | 5.5 | 6.8 | 7.0 |
| | Monocyclic aromatics ($C_6$~$C_8$) | 9.8 | 10.0 | 13.0 | 12.1 |
| | Cracked gasoline ($C_5$~200° C.) | 16.4 | 16.8 | 21.8 | 19.5 |
| | Heavy oil (higher than 200° C.) | 19.2 | 18.8 | 8.8 | 9.2 |
| Yield of main chemical starting materials (wt. %) (1) | | 59.3 | 59.0 | 67.0 | 64.8 |
| Yield of thermally cracked oil boiling at lower than 520° C. in the thermal cracking step (wt. %) (2) | | 85.3 | 84.5 | 84.5 | 84.7 |
| Yield of hydrotreated oil in the hydrotreating step (wt. %) (3) | | — | — | 99.1 | 99.1 |
| Yield of main chemical starting materials per feedstock (wt. %) (4) | | 50.6 | 49.9 | 56.1 | 54.4 |

Note
(1) Yield of main chemical starting materials = Ethylene yield + Propylene yield + Butadiene yield + Monocyclic aromatics ($C_6$~$C_8$) yield
(4) Yield of main chemical starting materials per feedstock = (1) × (2) × (3)

What is claimed is:

1. A process for converting a heavy hydrocarbon containing a fraction having a boiling point higher than 520° C. into a more valuable product which comprises:
   adding to the heavy hydrocarbon an oil-soluble transition metal compound and separately adding an ultra-fine powder selected from the group consisting of fine ceramics and carbonaceous substances which can be suspended in a hydrocarbon and has an average paticle size within the range of from 5 to 1000 mμ;
   cracking the heavy hydrocarbon in the presence of a hydrogen gas or a hydrogen sulfide-containing hydrogen gas; and
   recovering the resulting lighter hydrocarbon oil.

2. A process for converting a heavy hydrocarbon containing a fraction having a boiling point higher than 520° C. into a more valuable product which comprises:
   dissolving an oil-soluble transition metal compound in an oil;

dispersing an ultra-fine powder selected from the group consisting of fine ceramics and carbonaceouus substances having an average particle size within the range of from 5 to 1000 mμ in the oil solution;

heating the dispersion at the decomposition temperature of the transition metal compound in the presence of a hydrogen gas or a hydrogen sulfide-containing hydrogen gas;

separating a solid from the dispersion;

adding the solid to a heavy hydrocarbon;

cracking the heavy hydrocarbon in the presence of a hydrogen gas or a hydrogen sulfide-containing hydrogen gas; and recovering the resulting lighter hydrocarbon oil.

3. A process for converting a heavy hydrocarbon containing a fraction having a boiling point higher than 520° C. into a more valuable product which comprises:

(A) adding to a heavy hydrocarbon (i) an oil-soluble transition metal compound and an ultra-fine powder selected from the group consisting of fine ceramics and carbonaceous substances which can be suspended in a hydrocarbon and has an average particle size within the range from 5 to 1000 mμ separately;

(ii) a solid prepared by dissolving an oil-soluble transition metal compound in an oil; dispersing an ultra-fine powder selected from the group consisting of fine ceramics and carbonaceous substances having an average particle size within the range of from 5 to 1000 mμ in the oil solution; and heating the dispersion at the decomposition temperature of the transition metal compound in the presence of a hydrogen gas or a hydrogen sulfide-containing hydrogen gas;

(B) cracking the heavy hydrocarbon in the presence of a hydrogen gas or a hydrogen sulfide-containing hydrogen gas and recovering the resulting lighter hydrocarbon oil;

(C) removing a fraction having a high boiling point from the ligher hydrocarbon oil; and (D) pyrolyzing at least a portion of said lighter hydrocarbon oil with steam, and recovering a gaseous olefins product and a monocyclic aromatic product.

4. A process for converting a heavy hydrocarbon containing a fraction having a boiling point higher than 520° C. into a more valuable product which comprises:

(A) adding to a heavy hydrocarbon (i) an oil-soluble transition metal compound and an ultra-fine powder selected from the group consisting of fine ceramics and carbonaceous substances which an be suspended in a hydrocarbon and has an average particle size within the range of from 5 to 000mμ separately; or (ii) a solid prepared by dissolving an oil-soluble transition metal compound in an oil; dispersing an ultra-fine powder selected from the group consisting of fine ceramics and carbonaceous substances having an average particle size within the range of from 5 to 1000 mμ in the oil solution; and converting the dispersion to a solid by heating the dispersion at the decomposition temperature of the transition metal compound in the pressure of a hydrogen gas or a hydrogen sulfide-containing hydrogen gas;

(B) cracking the heavy hydrocarbon in the presence of a hydrogen gas or a hydrogen sulfide-containing hydrogen gas and recovering the resulting lighter hydrogen oil;

(C) removing a fraction having a high boiling point from the lighter hydrocarbon oil;

(D) hydrotreating at least a portion of said lighter hydrocarbon oil under hydrotreating conditions and recovering the resulting hydrotreated oil; and (E) pyrolyzing at least a portion of said hydrotreated oil with steam, and recovering a gaseous olefins product and a monocylic aromatics product.

5. The process according to claim 4, wherein the whole or a part of a solid which is separated and recovered from the lighter hydrocarbon oil obtained in step (B) or the fraction having a high boiling point removed in step (C) is recycled to step (B).

6. The process according to claim 4, wherein the whole or a part of the fraction having a high boiling point removed in step (C) is recycled to step (B).

7. A process for converting a heavy hydrocarbon containing a fraction having a boiling point higher than 520° C. into a more valuable product which comprises:

(A) adding to a heavy hydrocarbon (i) an oil-soluble transition metal compound and an ultra-fine powder selected from the group consisting of fine ceramics and carbonaceous substances which can be suspended in a hydrocarbon and has an average particle size within the range of from 5 to 1000 mμ separately; or (ii) a solid prepared by dissolving an oil-soluble transition metal compound in an oil; dispersing an ultra-fine powder selected from the group consisting of fine ceramics and carbonaceous substances having an average particle size within the range of from 5 to 1000 mμ in the oil solution; and converting the dispersion to a solid by heating the dispersion at the decomposition temperature of the transition metal compound in the presence of a hydrogen gas or a hydrogen sulfide-containing hydrogen gas;

(B) cracking the heavy hydrocarbon in the presence of a hydrocarbon gas or a hydrogen sulfide-containing hydrogen gas and recovering the resulting lighter hydrocarbon oil; and (C) hydrotreating at least a portion of said lighter hydrocarbon oil under hydrotreating conditions and recovering the resulting hydrotreated oil.

8. A process for converting a heavy hydrocarbon containing a fraction having a boiling point higher than 520° C. into a more valuable product which comprises:

(A) adding to a heavy hydrocarbon (i) an oil-soluble transition metal compound and an ultra-fine powder selected from the group consisting of fine ceramics and carbonaceous substances which can be suspended in a hydrocarbon and has an average particle size within the range of from 5 to 1000 mμ separately; or (ii) a solid prepared by dissolving an oil-soluble transition metal compound in an oil; dispersing an ultra-fine powder selected from the group consisting of fine ceramics and carbonaceous substances having an average particle size within the range of from 5 to 1000 mμ in the oil solution; and heating the dispersion at the decomposition temperature of the transition metal compound in the presence of a hydrogen gas or a hydrogen sulfide-containing gas;

(B) cracking the heavy hydrocarbon in the presence of a hydrogen sulfide-containing hydrogen gas and recovering the resulting lighter hydrocarbon oil;

(C) removing a fraction having a high boiling point from the lighter hydrocarbon oil; and (D) hydrotreating at least a portion of said lighter hydrocarbon oil under hydrotreating conditions and recovering the resulting hydrotreated oil.

9. A process for converting a heavy hydrocarbon into a more valuable product as claimed in claim 1 wherein the ultrafine power has an average particle size within the range from 10 to 50 mμ.

10. A process for converting a heavy hydrocarbon into a more valuable product as claimed in claim 2 wherein the ultrafine power has an average particle size within the range from 10 to 50 mμ.

11. The process according to claim 3, wherein the whole or a part of a solid which is separated and recovered from the lighter hydrocarbon oil obtained in step (B) or the fraction having a high boiling point removed in step (C) is recycled to step (B).

12. The process according to claim 3, wherein the whole or a part of the fraction having a high boiling point removed in step (C) is recycled to step (B).

* * * * *